US005932186A

United States Patent [19]

Romine et al.

[11] Patent Number: 5,932,186

[45] Date of Patent: Aug. 3, 1999

[54] ORGANOMETALLIC CONTAINING MESOPHASE PITCHES FOR SPINNING INTO PITCH CARBON FIBERS

[75] Inventors: H. Ernest Romine; James R. McConaghy, Jr., both of Ponca City, Okla.; John A. Rodgers, Ooltewah, Tenn.

[73] Assignee: Conoco Inc., Ponca City, Okla.

[21] Appl. No.: 08/957,887

[22] Filed: Oct. 27, 1997

Related U.S. Application Data

[62] Division of application No. 08/109,333, Jul. 27, 1993, Pat. No. 5,720,871, which is a continuation of application No. 07/628,314, Dec. 14, 1990, abandoned.

[51] Int. Cl.[6] ..... D01F 9/155

[52] U.S. Cl. ..... 423/447.2; 208/38; 208/45; 264/29.2; 423/447.5

[58] Field of Search ..... 252/299.01, 299.2; 208/39, 45; 423/447.1, 447.2, 447.5; 264/29.2

[56] References Cited

U.S. PATENT DOCUMENTS

| | | | |
|---|---|---|---|
| 4,208,267 | 6/1980 | Diefendorf et al. | 208/45 X |
| 4,277,324 | 7/1981 | Greenwood | 208/45 |
| 4,341,621 | 7/1982 | Fitzgerald | 208/45 |
| 4,460,454 | 7/1984 | Iijima et al. | 208/40 |
| 4,554,148 | 11/1985 | Gomi et al. | 423/447.1 |
| 4,600,496 | 7/1986 | Cheng et al. | 208/44 |
| 4,704,333 | 11/1987 | Elkins et al. | 423/447.1 |
| 5,720,871 | 2/1998 | Romine et al. | 208/39 |
| 5,730,949 | 3/1998 | Romine | 423/447.1 |

OTHER PUBLICATIONS

"Study of Carbonaceious Mesophase Through The E.S.R. Spectra of Vanadyl Chelates", Yamada et al., *Fuel,* 1978, vol. 57, Feb. 1979.

"Influence of Organic Sulfur Compounds and Metals on Mesophase Formation", Oi et al., *Carbon,* vol. 16, pp. 445–452, Jan. 1978.

*Primary Examiner*—Richard D. Lovering
*Attorney, Agent, or Firm*—William D. Hall

[57] ABSTRACT

An improved process is disclosed for producing a unique metals-containing anisotropic pitch suitable for carbon fiber manufacture. Soluble, aromatic-organometallic compounds are added to a carbonaceous feedstock which is substantially free of mesophase pitch and the resulting composition is heat soaked to produce an isotropic pitch product containing mesogens and soluble, aromatic-organometallic compounds. Next, the pitch product is solvent fractionated to separate mesogens which contain metals from the organometallic compounds. The metals-containing mesogens are heated to a temperature sufficient to cause fusion to produce a metals-containing mesophase pitch.

In another method, the carbonaceous feedstock is heat soaked to produce an isotropic pitch product containing mesogens and high molecular weight, soluble, aromatic-organometallic compounds are added to the mesogen containing isotropic pitch product prior to solvent fractionation. Metals-containing carbon fibers produced from the mesophase pitch exhibit enhanced stabilization, tensile strength and modulus properties.

Alternatively, the solvent fractionation or separation is conducted under supercritical extraction conditions to produce a metals-containing mesophase pitch. Organometallic compounds may be added to the carbonaceous feedstock either prior to or after the heat soak step.

3 Claims, No Drawings

ORGANOMETALLIC CONTAINING MESOPHASE PITCHES FOR SPINNING INTO PITCH CARBON FIBERS

This is a divisional of application Ser. No. 08/109,333 filed Jul. 27, 1993 now U.S. Pat. No. 5,720,871; which was a continuation of application Ser. No. 07/628,314 filed on Dec. 14, 1990, now abandoned.

FIELD OF THE INVENTION

The present invention resides in metals-containing carbon fibers and an improved process for producing a soluble, aromatic- organometallic-compound-containing mesophase pitch which is suitable for carbon fiber manufacture. More particularly, the invention relates to a process for making high strength carbon fibers which exhibit superior oxidative stabilization characteristics, tensile strength and modulus properties. The process comprises adding a soluble, aromatic-organometallic compound to a graphitizable, carbonaceous feedstock or adjusting the concentration of an aromatic-organometallic compound in a graphitizable, carbonaceous feedstock and heat soaking said carbonaceous feedstock to produce an isotropic pitch product containing mesogens and metals from the organometallic compound. The resulting pitch product is solvent fractionated using solvents near atmospheric pressure. Next, the metals-containing mesogens are heated to a temperature sufficient to cause fusion to produce a metals-containing mesophase pitch. The resulting metals-containing mesophase pitch is suitable for melt spinning into a fiber artifact.

In another method, the carbonaceous feedstock is heat soaked to produce an isotropic pitch product containing mesogens. High molecular weight, soluble aromatic organometallic compounds are then added to this isotropic pitch product and the resulting mixture is solvent fractionated to separate metals-containing mesogens.

Alternatively, the isotropic pitch product containing metals from either of the foregoing methods can be solvent fractionated at supercritical extraction conditions to produce a metals-containing mesophase pitch. When supercritical extraction is used, conditions are such that fused mesophase pitch is obtained directly making the mesogen fusion step unnecessary.

THE PRIOR ART

Processes for producing metals-containing pitches and/or carbon fibers are known and are currently practiced commercially. For example, U.S. Pat. No. 3,258,419, issued Aug. 16, 1977 relates to the use of a phosphoric acid and metal catalyst to promote air blowing of asphalts. The catalyst consists of phosphoric acid which contains dissolved metals.

U.S. Pat. No. 3,385,915, issued May 28, 1968, discloses a process for producing metal oxide fibers which consists of impregnating a preformed organic polymeric material with a metal. Cellulose and rayon are described as suitable organic polymeric materials.

U.S. Pat. No. 4,042,486, issued Aug. 16, 1977 relates to a process for converting pitch to a crystalloid which consists of coating solid amorphous pitch particles with a metal or metal salt prior to gas sparging and heat soaking to produce a mesophase pitch.

U.S. Pat. No. 4,554,148, issued Nov. 19, 1985 relates to a process for the preparation of carbon fibers which consists of subjecting a raw material oil to thermal cracking conditions to obtain a pitch product containing at least 5 weight percent mesophase. A substantially mesophase free pitch is obtained by removing mesophase of a particular particle size from the pitch product. The raw material oil is derived from a napthene base or intermediate base petroleum crude and contains metals.

U.S. Pat. No. 4,600,496, issued Jul. 15, 1986, discloses a process for converting pitch into mesophase in the presence of catalytically effective amounts of oxides, diketones, carboxylates and carbonyls of certain metals. The mesophase pitch obtained is described as suitable for use in the production of carbon fibers.

U.S. Pat. No. 4,704,333 relates to a process for the formation of carbon fibers produced from the pitch described in U.S. Pat. No. 4,600,496 above. The process consists of extruding said mesophase to form fibers, cooling the extruded fibers and subjecting the firers to elevated temperature to carbonize said fibers.

As can readily be determined from the above references, there is an ongoing research effort to determine new and more advanced processes and methods of producing various pitches and carbon fibers.

SUMMARY OF THE INVENTION

The present invention resides in metals-containing carbon fibers, metals-containing mesophase pitch and in at process for producing said metals-containing mesophase pitch which is readily spinnable into carbon fibers. The process for producing the metals-containing mesophase pitch herein comprises adding a soluble, aromatic-organometallic compound to a graphitizable carbonaceous feedstock. The metals-containing carbonaceous feedstock is heat soaked to produce an isotropic pitch product containing mesogens and soluble, aromatic-organometallic compounds. The resulting pitch product is solvent fractionated to separate metals-containing mesogens from the isotropic oil fraction. Thereafter, the mesogens are heated to a temperature that is sufficient to cause the mesogens to fuse and form a mesophase pitch which contains from about 50 PPM to about 20,000 PPM metals from the organometallic compounds.

In another method, the graphitizable carbonaceous feedstock is heat soaked to produce an isotropic pitch product containing mesogens, and a high molecular weight, soluble, aromatic-organometallic compound is added to the pitch product prior to solvent fractionation. Thus, the organometallic compounds herein may be added to the carbonaceous feedstock either prior to or after the heat soak step.

Solvent fractionation is conducted with solvents or solvent mixtures so as to isolate the desired mesophase formers (mesogens) from isotropic oils and particulate contaminants. Solvent fractionation is performed with liquid solvents at or near atmospheric pressure. Alternatively, the isotropic pitch product containing metals can be solvent fractionated at supercritical extraction conditions to produce a metals-containing mesophase pitch. When supercritical extraction is used, conditions are such that fused mesophase pitch is contained directly making the mesogen fusion step unnecessary.

The present invention provides for a metals-containing, mesophase pitch which is readily spinnable into a carbon artifact or fiber. The metals-containing mesophase pitch herein provides fibers having enhanced oxidative stabilization, tensile strength and modulus properties.

DETAILED DESCRIPTION OF THE INVENTION

In accordance with the present invention a soluble, aromatic-organometallic compound is added to a carbonaceous feedstock. The metals-containing carbonaceous feedstock is heat soaked to produce an isotropic pitch product containing mesogens and a soluble, aromatic-organometallic compound. The resulting pitch product is solvent fractionated to separate metals-containing mesogens. Thereafter, the metals-containing mesogens are heated to a temperature sufficient to produce mesophase pitch which contains metals from the soluble, aromatic-organometallic compound.

It should be noted that some carbonaceous feedstocks may contain minor or trace amounts of a metal compound therein. Whenever this occurs, it is desirable to adjust the metal content of the carbonaceous feedstock to the desired concentration. This is accomplished by adding the soluble, aromatic-organometallic compounds herein to the carbonaceous feedstock thereby adjusting said metals content of the carbonaceous feedstock to the desired concentration.

In another method, the carbonaceous feedstock may be heat soaked to produce an isotropic pitch product which contains mesogens. High molecular weight, soluble aromatic-organometallic compounds are then added to the pitch product prior to solvent fractionation. The organometallic compounds may be added to the carbonaceous feedstock either prior to or after the heat soak step.

Solvent fractionation is conducted with solvents or solvent mixtures so as to isolate the desired mesophase formers (mesogens) from isotropic oils and particulate contaminants. Solvent fractionation is performed with liquid solvents at or near atmospheric pressure. Alternatively, the solvent fractionation is conducted under supercritical extraction conditions of temperature and pressure to produce a mesophase pitch containing organometallic compounds.

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum or coal and other substances having properties of pitches produced as by-products in various industrial production processes.

The term "petroleum pitch" refers to the residuum carbonaceous material obtained from the thermal and catalytic cracking of petroleum distillates or residues.

The term "anisotropic pitch or mesophase pitch" means pitch comprising molecules having an aromatic structure which through interaction have associated together to form optically ordered liquid crystals.

The term "isotropic pitch" means pitch comprising molecules which are not aligned in optically ordered liquid crystals. Fibers produced from such pitches are inferior in quality to fibers made from mesophase pitches.

The term "mesogens" means molecules that interact or associate together to form mesophase pitch when in a fluids state.

Generally, graphitizable feedstocks having a high degree of aromaticity are suitable for carrying out the present invention. Carbonaceous pitches having an aromatic carbon content of from about 40 percent to about 90 percent as determined by nuclear magnetic resonance spectroscopy are particularly useful in the process. So, too are high boiling, highly aromatic streams containing such pitches or that are capable of being converted into such pitches.

It should be noted that carbonaceous pitches or graphitizable feedstocks that contain a high aliphatic content are also suitable for use herein. Organometallic enhancement of stabilization is especially effective in feedstocks that contain a high aliphatic content.

On a weight basis, useful graphitizable feedstocks will contain from about 88 percent to about 93 percent carbon and from about 9 percent to about 4 percent hydrogen. Elements other than carbon and hydrogen, such as sulfur and nitrogen, to mention a few, are normally present in such pitches. Generally, these other elements do not exceed about 5 percent by weight of the feedstock. Also, these useful feedstocks typically will have an average molecular weight of the order of about 200 to about 1,000.

In general, any petroleum or coal-derived heavy hydrocarbon fraction may be used as the carbonaceous feedstock in the process of this invention. Suitable graphitizable feedstocks in addition to petroleum pitch include heavy aromatic petroleum streams, ethylene cracker tars, coal derivatives, petroleum thermal tars, fluid catalytic cracker residues, and aromatic distillates having a boiling range of from 650°–950° F. The use of petroleum pitch-type feed is preferred.

The soluble, organometallic compounds of this invention may be either naturally occurring or synthetic organometallic compounds. It should be noted that the naturally occurring soluble organometallic compounds are preferred herein. The naturally occurring, soluble-organometallic compounds of this invention are at least partially aromatic and exhibit good thermal stability and have at least partial solubility in aromatic hydrocarbons. Generally, they come from the family of organometallic complexes found in the asphaltic fraction of crude petroleum. The aromatic-organo constituent of the organometallic compounds herein include porphyrins and related macrocyclic compounds with altered porphin ring structures. They also include porphins with added aromatic rings and/or with sulfur and oxygen as well as nitrogen ligands. Preferred organometallic compounds are relatively thermally stable porphin type structures which are readily dissolved in the carbonaceous feedstocks herein. These compounds often have fused aryl substituents. The metal constituent of the organometallic compounds herein is a metal or mixture of metals generally selected from the transition metals. Metals from the Groups VII or VIII of the Periodic Table are preferred.

Especially preferred metals from the above-described groups include vanadium, nickel, zinc, iron, copper, iridium, manganese and titanium and mixtures thereof. It should be noted that while all of the metals herein are suitable for use in the invention, vanadium and nickel are highly preferred with vanadium being especially preferred.

Applicants do not wish to be bound by theory, however, it is believed that the metals described above complex with the aromatic-organo constituents of the organometallic compounds and form chelates which are substantially soluble in the carbonaceous feedstocks herein.

An example of one source for naturally occurring soluble, aromatic-organometallic compounds suitable for use in this invention is Mayan (aka MAYA) crude. A concentrate can be prepared from Mayan crude which contains a substantial amount of soluble, aromatic-organometallic compounds.

Representative examples of soluble synthetic, organometallic compounds suitable for use include 5, 10, 15, 20-tetraphenyl-21H, 23H-porphine vanadium (IV) oxide; 5, 10, 15, 20-tetraphenyl-21H, 23H-porphine nickel (11); 5, 10, 15, 20-tetraphenyl-21H, 23H-porphine zinc; 5, 10 15, 20-tetraphenyl-21H, 23H-porphine cobalt (11) and 5, 10, 15, 20-tetraphenyl-21H, 23H-porphine copper and mixtures thereof. The synthetic vanadium organometallic compound is especially preferred. These synthetic organometallic compounds are manufactured and sold commercially by the Aldrich Chemical Company, located in Milwaukee, Wis.

The herein described organometallic compounds, including both naturally occurring and synthetic organometallic compounds, can be incorporated in the carbonaceous feedstock in any convenient manner. Thus, the organometallic compounds can be added directly to the carbonaceous feedstock by dissolving the desired organometallic compound in the carbonaceous feedstock at the desired level of concentration.

Alternatively, the organometallic compounds herein may be blended with suitable solvents to form organometallic compound-solvent mixtures that can be readily dissolved in the appropriate carbonaceous feedstock at the desired concentration. If an organometallic compound-solvent mixture is employed, it normally will contain a ratio of organometallic compound to solvent of from about 0.05:20 to about 0.15:10 respectively. It should be noted that solvent ratios outside this ratio range are equally suitable.

Solvents suitable for use in forming the mixtures herein include, petroleum based compounds, for example, gas oils, benzene, xylene and toluene and mixtures thereof. The particular solvent selected should, of course, be selected so as not to adversely affect the other desired properties of the ultimate carbonaceous feedstock composition.

Normally, the organometallic compound is added to the carbonaceous feedstock in a sufficient amount to impart a metals concentration in mesophase pitch produced from the carbonaceous feedstock of from about 50 PPM to about 20,000 PPM, especially from about 80 PPM to about 1,000 PPM, preferably from about 100 PPM to about 500 PPM of the metals from the organometallic compound in the mesophase pitch after solvent fractionation and fusion of the mesogens.

The soluble, aromatic-organometallic compounds are added to a carbonaceous feedstock and the metals-containing feedstock is subjected to a heat soak process to produce an isotropic pitch product containing mesogens and soluble, aromatic-organometallic compounds. The heat soak process conditions employed are well known in the art and include temperatures in the range of from about 350° C. to about 525° C., preferably from about 370° C. to about 425° C.; at a pressure of from about 0.1 to 27 atmospheres, for from about 1 minute to about 100 hours, especially from about 5 minutes to about 50 hours, preferably from about 2 hours to about 10 hours. It may be desirable to adjust the oil content of the heat soak pitch by vacuum deoiling at reduced pressures of between about 0.1 to about 75 millimeters Hg pressure either during or after the heat soak. The procedure for vacuum deoiling carbonaceous feedstocks is well documented in U.S. Pat. No. 4,219,404, the disclosure of which is incorporated herein by reference in its entirety. It should be noted that the heat soak is conducted for a period of time sufficient to allow mesogens to form in the feedstock but not for so long a time that more than 5 percent of the feedstock is converted to mesophase.

It may be desirable to contact the metals-containing carbonaceous feedstock with an oxidative reactive gas during the heat soak to accelerate the formation of mesogens. The preferred gas for the oxidative treatment of the carbonaceous feedstock is air and nitrogen or a mixture of oxygen and nitrogen wherein oxygen comprises from about 0.05 percent to about 5 percent of the gas mixture. Other oxidative reactive gases include ozone, hydrogen peroxide, nitrogen dioxide, formic acid vapor and hydrogen chloride vapor. These oxidative reactive gases may be used alone or in admixture with inert gases (non-oxidative) such as nitrogen, argon, xenon, helium, methane, hydrocarbon based flue gas and steam and mixtures thereof. Normally, the feedstock is contacted with the oxidative reactive gas at a rate of from about 1.0 to about 20 SCF of gas per pound of feedstock per hour. The procedure for contacting the carbonaceous feedstock with an oxidative reactive gas is more completely set forth in U.S. Pat. No. 4,892,642, the disclosure of which is incorporated by reference herein in its entirety.

Relatively low molecular weight organometallic compounds are suitable for use herein when the organometallic compounds are added to the carbonaceous feedstock prior to heat soaking. These organometallic compounds will participate in the mesogen forming heat soak reaction and therefore grow in size to substantially the approximate size of mesogens formed during the heat soak process. Thus, smaller organometallic compounds in the metals-containing feedstock tend to become incorporated in the mesogens during the heat soak process. Relatively high molecular weight organometallics do not need to be present during heat soaking but their presence during heat soaking is suitable for use herein.

When concentrates of naturally occurring aromatic organometallic compounds are added to a graphitizable carbonaceous feedstock and the mixture is heat soaked, it is important that the mesogens in the resulting heat soaked pitch are graphitizable materials. Therefore, it is desirable that the concentrates are graphitizable carbonaceous materials.

Alternatively, the graphitizable carbonaceous feedstock may be heat soaked to produce an isotropic pitch product containing mesogens and, then, the soluble, aromatic-organometallic compound is added to the pitch product prior to solvent fractionation. When this route is practiced the soluble, aromatic-organometallic compound can be either natural or synthetic of the types already described. The soluble aromatic-organometallics can be added alone or as concentrates and they can be blended with the mesogen-containing isotropic pitch in any convenient way. When the soluble, aromatic-organometallics are added as naturally occurring concentrates, concentrates with relatively high metals contents of greater than 50 ppm or even greater than 1000 ppm are preferred. It is not necessary for the concentrate to be a graphitizable carbonaceous material as long as the concentrate does not prevent the mesogens isolated by extraction from being graphitizable. Mayan resid and Mayan crude asphaltines are examples of suitable naturally occurring concentrates for the practice of this aspect of the invention.

When the soluble, aromatic-organometallic compounds are added to the pitch product after the heat soak step, it is important to only use high molecular weight, organometallic compounds. A substantial portion of the high molecular weight, organometallic compounds co-precipitate with mesogens from the isotropic pitch during solvent fractionation. The solvent fractionation step of the process is selective to separating and concentrating high molecular weight, soluble, aromatic-organometallic compounds with the mesogens from the pitch product. Lower molecular weight, organometallic compounds remain soluble during solvent fractionation. It should be noted that suitable high molecular weight organometallic compounds are not required to be insoluble under conditions that precipitate mesogens. It is only required that a substantial portion of the organometallics co-precipitate with the mesogens. High molecular weight, soluble, aromatic-organometallic compounds suitable for use herein are those organometallic compounds wherein a substantial portion have a molecular weight within the range of from about 800 to about 2,000.

The isotropic pitch product, which contains mesogens and soluble, aromatic-organometallic compounds, as formed by heat soaking or mixing as taught above is subjected to solvent fractionation to produce, after fusion, a metals-containing mesophase (anisotropic) pitch suitable for spinning into carbon artifacts or fibers. Solvent fractionation is carried out by the following steps:

(1) Fluxing the isotropic pitch product which contains mesogens and soluble, aromatic-organometallic compounds in an aromatic solvent, (2) Separating flux insolubles by filtration, centrifugation or other suitable means, (3) Diluting the flux filtrate with an anti-solvent to precipitate a metals-containing mesophase pitch precursor, e.g., mesogens including organometallic compounds, and washing and drying the mesophase pitch precursor.

The fluxing and flux insolubles removal steps of solvent fractionation can be omitted. This is especially true when the isotropic pitch being solvent fractionated is a clean material such as obtainable by hot filtering. Highest carbon fiber properties are obtained in the preferred aspect of the invention, wherein the isotropic pitch containing mesogens and soluble organometallic compounds is mixed with a fluxing solvent and is fluxed to solubilize the mesogens. A variety of solvents are suitable for use as the fluxing material. They include aromatic compounds such as benzene and naphthalene, naptheno-aromatics such as tetralin and 9,10-dihydroanthracene, alkyl aromatics such as toluene, xylenes and methyl naphthalenes, hetero-aromatics such as pyridine, quinoline and tetrahydrofuran; and combinations thereof. Also suitable are simple halo carbons, including chloro and fluoro derivatives of paraffin hydrocarbons ontaining 1 to 4 carbon atoms such as chloroform and trichloroethane and halogenated aromatics such as trichlorobenzene. In general, any organic solvent which is non-reactive with the pitch and which, when mixed with the pitch in sufficient amounts, is capable-of solubilizing the mesogens may be used in carrying out the process of the invention. At temperatures above about 500° C., undesirable reactions can take place with or between aromatic compounds in the pitch. Thus, the solvent must have the required solubilization behavior at temperatures below about 500° C.

The amount of fluxing solvent used will vary depending upon the temperature at which mixing is conducted and the composition of the pitch. In general, the amount of solvent used will be in the range of between about 0.05 parts by weight of solvent per part by weight of pitch to about 2.5 parts by weight of solvent per part by weight of pitch. Preferably, the weight ratio of flux solvent to pitch will be in the range of from about 0.7 to 1 to about 1.5 to 1. The fluxing operation is usually carried out at an elevated temperature and at sufficient pressure to maintain the system in the liquid state. Mixing or agitation are provided during the fluxing operation to aid in the solubilization of the mesogens and organo-metallic compounds. Usually the fluxing operation is performed at a temperature in the range of between about 30 and about 150° C. and for a time period of between about 0.1 and about 2.0 hours. However, fluxing may be carried out up to the boiling point of the solvent at system pressure.

Upon completion of the fluxing step, the solubilized mesogens and organometallic compounds are separated from the insoluble portion of the pitch by the usual techniques of sedimentation, centrifugation or filtration. If filtration is the selected separation technique used, a filter aid may be employed, if desired, to facilitate the separation of the fluid material from the solids. The solid materials which are removed from the fluid pitch consist of materials such as coke and catalyst fines which were present in the pitch prior to heat soaking, as well as those insolubles generated during heat soaking. If heat soaking conditions are not carefully controlled, mesophase may be generated in the pitch during heat soaking. This mesophase is partially lost in the flux process since it is predominantly insoluble in the flux mixture and is removed with the other insolubles during the separation process. In the process of the invention, isotropic pitch, which is substantially free of mesophase, is preferred since this means that the prior treatment of the pitch has been accomplished in a manner to provide for a maximum amount of mesogens in the pitch prior to solvent fractionation.

After removal of the solids from the system, the remaining pitch solvent mixture containing dissolved mesogens and organometallic compounds is treated with a comix or anti-solvent so as to precipitate organometallic-containing mesogens from the pitch. The isotropic pitch which contains mesogens and organometallic compounds may be contacted with the comix or anti-solvent in either a one step or a two step process.

Preferably, the comix or anti-solvent systems include a mixture of aromatic hydrocarbons such as benzene, toluene, xylene and the like and aliphatic hydrocarbons such as hexane, heptane cyclohexane, methyl cyclohexane and the like. A particularly desirable comix or anti-solvent is a mixture of toluene and heptane. Generally, the aromatic-aliphatic comix will be admixed in a volume ratio of from about 6:4 to about 9.1:0.1. Typically, the comix or anti-solvent is added to the isotropic pitch at a ratio of from about 5 ml to about 150 ml of anti-solvent per gram of isotropic pitch. This ratio range is sufficient to precipitate metals-containing mesogens from the isotropic pitch system. After precipitation of the metals-containing mesogens from the isotropic pitch, separation of the metals-containing mesogens from the isotropic pitch can be performed using conventional techniques such as sedimentation, centrifugation, filtration and the like. The solvent fractionation procedure herein, including fluxing liquids, anti-solvent liquids, ratios of fluxing liquids or anti-solvent liquids to the pitch product produced after the heat soak procedure are set forth in greater detail in U.S. Pat. Nos. 4,277,324 and 4,277,325 the disclosures of which are incorporated herein by reference in their entirety.

Alternatively, the isotropic pitch can be extracted to give an insoluble residue which is a mesophase pitch precursor as taught in U.S. Pat. No. 4,208,267. For example, U.S. Pat. No. 4,208,267 discloses a process for producing mesophase pitch wherein a carbonaceous isotropic pitch is extracted with a solvent to provide a solvent insoluble fraction having a sintering point below about 350° C. The solvent insoluble fraction is separated from the solvent soluble fraction and said solvent insoluble fraction is subjected to heat treatment to produce an optically anisotropic pitch. The disclosure of U.S. Pat. No. 4,208,267 is incorporated by reference herein in its entirety.

After the solvent fractionation step, the metals-containing mesogens are heated to a temperature sufficient to cause the mesogens to fuse and form a metals-containing mesophase pitch. The mesogens are heated up to 400° C. but below the decomposition temperature of said mesogens to promote the formation of mesophase pitch. Preferably, the mesogens are heated to 10° C. to 30° C. above their sintering temperature to a temperature of from about 230° C. to about 400° C. The metals-containing mesophase pitch thus formed typically exhibits a softening temperature of from about 230° C. to about 380° C. when heated on a hot stage microscope.

Alternatively, the isotropic pitch product containing mesogens and soluble, aromatic-organometallic compounds from the above-described heat soak step is subjected to supercritical extraction conditions of temperature and pressure to produce a metals-containing mesophase pitch. When supercritical extraction is used, the solvent should also have a critical temperature below about 500° C. In the supercritical extraction process, the isotropic pitch product, which contains mesogens and soluble, aromatic-organometallic compounds is subjected to supercritical extraction conditions of temperature and pressure to produce a metals-containing mesophase pitch. Supercritical extraction is carried out by the following steps:

(1) fluxing the isotropic pitch product which contains mesogens and soluble, aromatic-organometallic compounds in an aromatic solvent, (2) separating flux insolubles by filtration, centrifugation or other suitable means, (3) subjecting the flux solubles to supercritical extraction conditions of temperature and pressure to produce a metals-containing mesophase pitch.

The pitch solvent mixture of step (3) above containing dissolved mesogens and organometallic compounds is subjected to supercritical temperature and pressure conditions, i.e. temperature and pressure at or above the critical temperature and critical pressure of the flux solvent to effect phase separation of the mesogens from the pitch. In the case of toluene, for example, the critical conditions are 319° C. and 611 psia. The time required to separate mesogens from the system will vary, depending on the particular pitch and the solvent employed and the geometry of the separation vessel. Generally, a time of from about 1 minute to about 60 minutes is sufficient to separate mesogens from the system.

If desired, additional solvent may be added, for example, during supercritical extraction. The amount of such added solvent may be up to about 12 parts of solvent by weight per part by weight of pitch and preferably from about 0.5 to about 8 parts of solvent per part of pitch. If additional solvent is added, agitation or mixing is desirable to promote intimate interphase contact.

In the prior art method of solvent fractionation of isotropic pitch, which included the use of a comix or anti-solvent, a fusing operation served to convert the mesogens to mesophase pitch. In the process of this invention, fusing is not necessary to accomplish this conversion since the product obtained from the supercritical phase separation step is mesophase rather than mesogens.

The supercritical conditions applied in carrying out the process of the invention will vary depending on the solvent used, the composition of the pitch and the temperature employed. The level of supercritical pressure may be used to control the solubility of the pitch in the solvent and thus establish the yield and the melting point of the mesophase product. For example, at a given temperature and solvent-to-pitch ratio, if the pressure on the system is increased, the solubility of the pitch in the solvent also increases. This results in a lower yield of higher melting point, metals-containing mesophase product. Lowering the pressure gives the opposite result. Generally, the supercritical temperature employed will be at or somewhat above the critical temperature of the solvent, e.g. from 0 to about 100° C. above the solvent critical temperature. If desired, higher temperatures may be used; however, they are not required. The pressure maintained on the system will vary over a wider range since it is most conveniently used for controlling product properties and yield. Thus, the pressure applied on the system may be up to twice as high as the critical pressure or higher if desired.

The temperature and pressure required for the process herein are the same as or higher than the critical temperature and pressure of the solvent used in the process. Suitable solvents are those solvents which have critical temperatures in the range of from about 109° C. to about 500° C. The upper temperature limit is controlled by the thermal stability of the pitch and/or solvent mixture. The lower temperature limit is set by the critical temperature of the particular solvent used. Preferred solvents have critical temperatures above 200° C.; however, other solvents such as the halocarbons have lower critical temperatures. For example, chlorotrifluoromethane has a critical temperature of 29° C. The process temperature is typically up to about 100° C. above the critical temperature of the solvent or higher. The process pressure is generally from about 300 psig to about 5,000 psig, preferably from about 500 psig to about 3,000 psig. It should be noted however, that some pitch/solvent process systems may utilize higher or lower pressures. The system pressure varies over a wide range since it is most conveniently used for controlling product properties and yield. Thus, the pressure applied to the system may be up to twice as high as the critical pressure of the solvent or higher.

The amount of solvent used in the process and the temperature employed also affect the solubility of the pitch in the solvent which in turn affects the melting point of the metals-containing mesophase product. Increasing the amount of solvent decreases the amount of pitch solubilized at low solvent to pitch ratios (1 to 1) but slightly increases the amount of pitch solubilized at high solvent to pitch ratios (10 to 1). Changes in the solvent to pitch ratios which result in a reduced yield produce a metals-containing mesophase product of increased melting point.

Upon completion of phase separation of the mesogens (now mesophase) and organometallic compounds from the pitch, solvent dissolved in the mesophase may be removed by reducing the system pressure while maintaining the temperature at a sufficient level to maintain the mesophase in the liquid state. Solvent removal is usually carried out at a temperature of between about 300 and about 400° C. for between about 0.01 and about 2 hours, depending on the type of solvent removal procedure used. For example, with thin film evaporation only very short residence times are required.

In addition to the conventional solvent fluxing, the process of this invention also includes enhanced fluxing. Enhanced fluxing employs elevated temperatures and pressures up to the critical conditions for the flux mixture. Enhanced fluxing offers higher solubility leading to improved yields. It also offers process advantages such as greater compatibility with the supercritical conditions employed in the process and easier flux filtering of less viscous mixtures. The solvent ratio employed with enhanced fluxing will vary from between about 0.5 and about 2.5 parts by weight of solvent per part of weight by pitch.

After removal of the solvent, the metals-containing liquid mesophase recovered under the supercritical conditions of the invention may be spun directly, or alternatively this material may be cooled to a solid phase material for transport and storage. If desired, the mesophase product may be solvent washed and dried as in the conventional two solvent process.

In the preferred aspect of the invention, as before-described, solvent fluxing of the heat soaked isotropic pitch and filtration of the flux mixture removes inorganic contaminants and flux insoluble components from the desired product. This results in a high quality metals-containing mesophase having a very low quinoline insolubles content. Dense phase or supercritical separation of the mesogens and organometallic compounds from the pitch may also be effected without the fluxing or filtration steps to provide a desirable metals-containing mesophase product. While the metals-containing mesophase obtained by this simplified process is not of as high quality as that resulting from fluxing and filtration, it is more economical and suitable for use in many applications. In this aspect of the invention the heat soaked isotropic pitch containing organometallic compounds and mesogens is combined with the solvent in a suitable manner. For example, the pitch may be melted and combined with heated solvent and the combination then subjected to supercritical conditions. Alternatively, the pitch may be subjected to supercritical conditions of the particular solvent used and then combined with solvent, also provided under supercritical conditions. After they are combined, the pitch and solvent are subjected to mixing or agitation to provide an intimate admixture of the materials prior to effecting phase separation. Thereafter, the procedure followed is the same as that previously described for the invention subsequent to the filtration step. The solvents employed in this aspect of the invention are the same as those previously listed. The amount of solvent used is up to about 12 parts per part by weight of pitch and preferably from about 0.5 to about 8.0 parts of solvent per part of pitch.

The mesophase pitch of this invention contains from about 50 PPM to about 20,000 PPM metals from the soluble, aromatic-organometallic compound which was added to the graphitizable carbonaceous feedstock and may be formed into metals-containing carbon artifacts using conventional techniques or spun into metals-containing anisotropic carbon fibers by procedures such as melt spinning, centrifugal spinning, blow spinning and the like. It should be noted that thus carbon artifacts or carbon fibers produced in accordance with the procedure set forth herein contain substantially the same metals and concentration of metals delineated in the description of metals-containing mesophase pitches.

The metals in the melt spun fibers promote enhanced reactivity with oxygen during stabilization, resulting in a faster rate of stabilization. The faster rate of carbon fiber stabilization is important from a commercial point of view because it allows for better regulation of stabilization reactions at relatively milder stabilization conditions. The end result is substantially improved fiber properties when relatively thick bundles of fibers are stabilized such as in commercial operations. In commercial production of carbon fiber, stabilization is a slow, expensive process step. Stabilization economics is improved by processing relatively high densities or thick bundles of fibers. The ability to increase bundle size is limited by increasing amount of non-uniform stabilization and poorer fiber properties. The metals-containing pitches herein, which exhibit enhanced stabilization properties, stabilize faster and more uniformly as compared to pitches and fibers which do not contain metals. The faster stabilization rate of the carbon fibers in the process herein promotes uniform, homogeneous stabilization and enhanced fiber tensile strength. This concept is exemplified in Examples IV and V below where processing of ¼ inch thick fiber bundles on spools is described.

It should be noted that thin bundles of fibers such as used in experimental tray stabilization do not show the fiber property improvement from incorporation of metals. They do show enhanced oxidative stabilization rates as shown in the Examples. Property improvement is not expected since uniform, homogeneous stabilization is easily achievred on these small fiber bundles.

The benefit of soluble, aromatic-organometallic compounds in promoting oxidative stabilization occurs independent of the method used to prepare the soluble, aromatic-organometallics containing mesophase pitch. The benefit occurs in either extracted or sparge type mesophase pitches as shown in the Examples.

The artifacts and fibers herein are carbonized and graphitized using conventional techniques and procedures in the art. For example, carbonization of the artifacts or fibers is effected at a temperature of from about 1,000° C. to about 2,200° C., preferably from about 1,400° C. to about 1,700° C. from about 1 to about 60 minutes. If desired, the carbonized fibers may be graphitized by further heating in an inert atmosphere to a temperature of from about 2,200° C. to about 3,200° C., preferably from about 2,800° C. to about 3,000° C. for a period of from about 1 second to about 5 minutes. In some instances a longer heating period is desired for example, up to 10 minutes or longer. Note that some or substantially all of the metals present in the mesophase pitch and/or carbonized artifacts produced therefrom may be evolved during the graphitization step. It is only important that the metals be present during the stabilization or oxygenation step to achieve the enhanced benefits herein. Thus, these enhanced benefits of the fibers herein are achieved prior to the graphitization step and the evolution of some or substantially all of the metals present during the graphitization step does not diminish the enhanced properties imparted to the fibers by the metals during the stabilization step.

The following examples serve to demonstrate the best mode of how to practice the invention herein and should not be construed as a limitation thereof.

EXAMPLE I

A metals-containing mesophase pitch for melt spinning was prepared by topping a mid-continent refinery decant oil to produce an 850° F.+residue. The residue was 91.8% carbon, 6.5% hydrogen, 35.1% carbon residue and 81.6% aromatic carbons as analyzed by C13 NMR. The decant oil residue was heat soaked 6.3 hours at 740° F. (393° C.) and then vacuum deoiled to produce a heat soaked pitch.

Mayan crude was topped to produce Mayan resid (46.8% yield). The concentrated resid was mixed with toluene at a 1:1 ratio and the mixture was filtered across a 1.2 micrometer fluorocarbon filter. The concentrated resid was stripped of toluene. The resid was analyzed by emission spectroscopy to contain 970 PPM ash which tested greater than 90% vanadium oxides.

A mixture of the heat soaked decant oil pitch (85 wt. %) and Mayan resid (15 wt. %) was solvent fractionated in accordance with the following procedure:

The decant oil pitch and Mayan resid mixture was mixed with toluene in a 1:1 ratio. Celite filter aid (0.15 wt. %) was added to the above mixture and the mixture was fluxed with stirring for 1 hour at 110° C. and filtered. Flux insolubles amounted to 7.6% of the pitch mixture.

The flux filtrate was combined with hot comix solvent at a ratio of 4 ml comix:1 gm flux filtrate to form a rejection mixture. The comix was a 4 ml:1 ml mixture of toluene-:heptane. The stirred rejection mixture was heated to 90° C., held at that temperature for one hour, cooled to 30° C., held at 30° C. for 1½ hours and finally filtered to recover the precipitated pitch product. The pitch product was washed with 2.6 cc of 15° C. comix followed by 0.75 cc of 22° C. heptane per gram of original pitch mixture. Mesogen powder was dried and recovered (19.4% yield).

The product melted at 307° C. to form a 100% anisotropic mesophase pitch as determined by hot stage microscopy. The pitch ash content was 90 PPM which tested greater than 80% vanadium oxides by emission spectroscopy.

The product mesophase pitch was melt spun into carbon fibers. Spinning was excellent at 335° C. Tray stabilized, carbonized fibers tested at 415 Mpsi tensile strength and 34 MMpsi tensile modulus. Oxidative DSC of the as spun fibers indicated a 29% reduction in the time required to reach a level of oxidation corresponding to stabilization as compared to the control fiber of Example III below.

EXAMPLE II

A heat soaked aromatic pitch was combined with a Mayan crude asphalt fraction and the mixture was solvent fractionated to make a mesophase pitch for spinning.

The same heat soaked, vacuum deoiled decant oil pitch used in Example I was used in this Example.

Mayan Crude was topped (900° F.) to produce Mayan resid (46.0% yield). Mayan asphaltenes were isolated from the Mayan resid as the 35% Richfield pentane insolubles by dissolving the resid in an equal weight of toluene. Mayan asphaltenes were precipitated by adding 20 grams of pentane per gram of resid to the resid-toluene mixture. The asphaltenes analyzed 3000 ppm ash which tested greater than 90% vanadium oxides utilizing emission spectroscopy.

Solvent fractionation was carried out in accordance with the procedure of Example 1. The pitch feed to solvent fractionation was comprised of 95% heat soaked decant oil pitch and 5% Mayan asphaltenes. Flux insolubles amounted to 6.9% of the pitch plus Mayan asphaltenes. The Comix volume ratio for this Example was 88:12 of a toluene to heptane mixture. The Comix to pitch ratios during the rejection and washing steps were the same as those used in Example I. The product yield was 19.3 percent. The product pitch was 90% mesophase, which melted at 322° C. as analyzed by hot stage microscopy. The ash content of the mesophase pitch was 150 ppm which tested greater than 90% vanadium oxides as analyzed by emission spectroscopy.

The mesophase pitch was melt spun with excellent results at 340° C. The stabilized and carbonized fibers from the melt spun, mesophase pitch tested 425 Mpsi tensile strength at 36 MMpsi tensile modulus.

EXAMPLE III (Comparative)

The procedure of Example I was followed to prepare a mesophase pitch with the following exceptions:

The concentrated Mayan resid was not added to the topped mid-continent refinery decant oil. The comix solvent was a toluene: heptane mixture at a volume ratio of 92:8.

The mesophase pitch showed excellent spinnability at 340° C. Tray stabilized, carbonized fibers had a tensile strength of 445 Mpsi and a tensile modulus of 34 MMpsi. The time required to reach a level of oxidation corresponding to stabilization was 29% greater as compared to Example I.

EXAMPLE IV

A metals-containing mesophase pitch for melt spinning was prepared by blending a mixture of ¾ mid-continent refinery decant oil 850° F.+residue and ¼ mid-continent gas oil 815° F.+residue. The mixture contained concentrated soluble, naturally occurring organometallics from petroleum. The mixture tested 90.2% carbon and 7.5% hydrogen. The mixture was heat soaked for 7.2 hours at 741° F. (394° C.) and then vacuum deoiled.

The heat soaked pitch was solvent fractionated using the procedure of Example I except that 6.9 ml of comix was used per gram of pitch. The Comix was a 4 ml:1ml mixture of toluene to heptane. The mesogen powder tested 100% mesophase after melting at 350° C. as analyzed by hot stage microscopy. The product analyzed 164 PPM total ash which analyzed as 129 PPM of vanadium oxides and 30 PPM nickel oxides by x-ray spectroscopy. The mesophase power showed excellent spinnability at 360° C. The stabilized, carbonized fibers tested at a tensile strength of 518 Mpsi and a tensile modulus of 36.5 MMpsi.

The fibers were stabilized in ¼ inch thick bundles on spools by two stage oxidation. They were heated at 240° C. over a period of 325 minutes in the presence of 14% oxygen in the first stage. Stabilization was complete after 30 minutes treatment at 245 to 249° C. with 0.5% oxygen in the second stage. The match test was used to determine that the fibers were stabilized. In this test, the flame of a burning match is played across the fibers. Any melting or fusion of the fibers indicates incomplete stabilization.

The carbonized fibers were ashed and the ash was analyzed for metals. The equivalent of 229 PPM of vanadium oxide was found in the ash.

EXAMPLE V (Comparative)

The procedure of Example IV was used to prepare a carbon fiber with the following exception:

The heat soaked pitch was prepared from mid-continent refinery decant oil 850° F.+residue and did not contain organometallic compounds. The resulting mesophase powder showed excellent spinnability and fibers produced therefrom had a tensile strength of 410 Mpsi and a tensile modulus of 36.5 MMpsi.

When the procedure to spool stabilize the fibers disclosed in Example IV was used, the fibers were not stabilized. In other words, the fibers melted when tested utilizing the match test. Increasing the stage two 245 to 249° C. treatment to 40 minutes with 14% oxygen plus 15 minutes with 0.5% oxygen still resulted in unstabilized fibers. Stabilization of the fibers required a stage two treatment of 14% oxygen for 70 minutes plus 15 minutes with 0.5% oxygen.

EXAMPLE VI

A metals-containing mesophase pitch suitable for melt spinning was prepared by topping a mid-continent refinery decant oil to produce an 850° F.+residue. Next, 0.2% of 5,10,15, 20-tetraphenyl-21H, 23H-porphine vanadium oxide (Aldrich Chemical Company) and 27% toluene cosolvent was added to the residue. The resulting mixture was heated with stirring for four hours at reflux. After removal of the toluene, the resulting aromatic residue contained 150 ppm of added vanadium (IV) oxide.

The vanadium spiked aromatic residue was heat soaked for 7 hours at 752° F. and then vacuum deoiled to produce a synthetic, metals-containing heat soaked pitch. This pitch tested 17.2% tetrahydrofuran insolubles.

The heat soaked, vacuum deoiled decant pitch was solvent fractionated by first fluxing with toluene on an equal weight basis. Celite filter aid (0.15 wt %) was added to the flux mixture and the flux mixture was filtered using a 0.2 micrometer membrane. The flux filtrate was combined with Comix consisting of a 90:10 volume ratio of toluene to heptane to give a rejection mixture consisting of 8 ml of Comix per gram of heat soaked pitch. The rejection mixture was heated with stirring to 100° C., held at 30° C. for 5 hours and then filtered to recover the precipitated product (19.9% yield). The product thus produced was washed successively with 15° Comix and 22° C. heptane. The product tested 100% mesophase with a melting point of 348° C. as analyzed by hot stage microscopy. X-ray analysis showed 416 ppm of vanadium in the mesophase. In addition, the product tested 542 ppm ash with in excess of. 90% being vanadium oxide as determined by emission spectroscopy.

EXAMPLE VII (Comparative)

A metals-containing mesophase pitch suitable for melt spinning was prepared by topping a mid-continent refinery decant oil to produce an 850° F.+residue. The decant oil residue was heat soaked 6.3 hours at 740° F. and then vacuum deoiled to produce a heat soaked pitch. This pitch tested 16.4% tetrahydrofuran insolubles at 75° F. with 1 gram of pitch per 20 ml of tetrahydrofuran.

The heat soaked, vacuum deoiled decant pitch was solvent fractionated by first fluxing with toluene on an equal weight basis. During fluxing, 0.2% of 5,10,15, 20-tetraphenyl-21H, 23H-porphine vanadium (IV) oxide (Aldrich Chemical company) was added to the flux mixture. Celite filter aid (0.15wt %) was added to the flux mixture and the flux mixture was filtered using a 0.2 micrometer membrane.

Next, the flux filtrate was combined with Comix consisting of a 88:12 volume ratio of toluene to heptane to give a rejection mixture consisting of 8 ml of Comix per gram of pitch. The rejection mixture was heated with stirring to 100° C., held at 30° C. for 5 hours and finally filtered to recover the precipitated product (22.9% yield). The resulting product was washed successively with 15° C. Comix and 22° C. heptane. The product tested 90% mesophase with a melting point of 308° C. as determined by hot stage microscopy. The ash content was determined to be 40 ppm indicating poor transfer of metals to the mesogen fraction.

EXAMPLE VIII

A vanadium containing mesophase pitch suitable for melt-spinning was prepared by topping a mid-continent refinery decant oil to produce an 850° F.+residue. This residue was mixed with 0.15% of 5,10,15,20-tetraphenyl-21H, 23H-porphine vanadium (IV) oxide and 10% toluene cosolvent. The pitch containing metals was heat soaked 32 hours at 385° C. Nitrogen was bubbled through the residue during heat soak at a rate of 4SCF per hour per pound of feed. The residue product tested 100% mesophase with a melting point of 320° C. and a yield of 23.9%. The resulting mesophase pitch yielded 644 ppm residue when ashed, which tested greater than 90% vanadium oxides as analyzed by emission spectroscopy.

The mesophase product was melt spun into carbon fibers with fair spinnability at 360° C. The stabilized, carbonized fibers tested 380 Mpsi tensile strength and 45 MMpsi tensile modulus. A level of oxidation corresponding to stabilization was reached 13% sooner with this fiber as compared to the control fiber of Example IX below.

EXAMPLE IX (Comparative)

A mesophase pitch suitable for melt spinning was prepared in accordance with the procedure set forth in Example VIII above with the following exception:

The compound 5,10,15, 20-tetraphenyl-21H, 23H-Phorphine vanadium (IV) oxide and toluene cosolvent were not added to the 850° F.+residue of topped mid-continent refinery decant oil. The resulting product pitch tested 100% mesophase, with a melting point of 300° C. as determined by hot stage microscopy and a yield of 23.0%. The ash content of the mesophase pitch was determined to be less than 5 ppm. The mesophase pitch exhibited good spinnability when spun into carbon fibers at 320° C. The stabilized, carbonized fibers tested 390 Mpsi tensile strength and 36 MMpsi tensile modulus.

EXAMPLE X

A supercritical extraction of a metals-cortaining isotropic feedstock is conducted in accordance with the following procedure:

An isotropic feedstock is prepared by heat soaking an 850+° F. cut of decant oil from an FCC unit for six hours at 741° F.

Mayan crude is topped to produce Mayan resid (46.8% yield). The concentrated resid is mixed with toluene at a 1:1 ratio and the mixture is filtered across a 1.2 micrometer fluorocarbon filter. The concentrated resid is stripped of toluene. The resid is analyzed by emission spectroscopy to contain 970 PPM ash which tests greater than 90% vanadium oxide.

A mixture of the heat soaked decant oil pitch (85 wt. %) and Mayan resid (15 wt. %) is solvent fractionated under supercritical conditions in accordance with the following:

The metals-containing, heat soaked pitch is then fluxed by conventional means by combining the pitch and flux solvent (toluene) in about equal amounts at the reflux temperature of toluene. Flux filtration of the mixture removes particles down to submicron size.

A 2-liter high pressure stirred autoclave is charged with 570 g of flux filtrate and 665 g of toluene. The system is raised to 340° C. under autogeneous pressure and an additional 790 g of toluene are added to raise the pressure to 1190 psia. The resulting mixture is agitated at 340° C. and 1190 psia for one hour and then allowed to settle ½ hour. The bottoms phase is recovered and dried of residual toluene. The dried product analyzed 100% mesophase melting at 335° C. by hot stage microscopy. The material is press spun into carbon fibers which are tray stabilized and carbonized by conventional means. Stabilization occurs at milder conditions than required for non-metals-enhanced mesophase pitch fibers.

EXAMPLE XI

A supercritical extraction of a metals-containing isotropic feedstock is conducted in accordance with the procedure of Example X with the following exception:

The feedstock comprises a blend of ¾ percent mid-Continent refinery decant oil (850° F.+residue) and ¼ percent mid-Continent gas oil (815° F.+residue). The mixture contains soluble, naturally occurring organometallics from petroleum. The mixture is heat soaked, fluxed and supercritical extreated to produce a mesophase. Carbon fibers from this mesophase show enhanced oxidation stabilization.

Obviously, many modifications and variations of the invention, as herein above set forth, can be made without departing from the spirit and scope thereof, and therefore only such limitations should be imposed as are indicated in the appended claims.

We claim:

1. Graphitizable metals-containing as spun mesophase pitch fibers having enhanced oxygen reactivity properties which contain from about 50 PPM to about 1000 PPM metals from at least one organometallic compound, said organometallic compound has a porphin type structure and is thermally stable at temperatures of 350° C. or greater.

2. The graphitizable, metals-containing as spun fibers of claim 1, wherein the fibers contain from about 80 PPM to about 1,000 PPM of the metals from at least one organometallic compound.

3. The graphitizable, metals-containing as spun fibers of claim 1, wherein the metal component of said organometallic compound is selected from the group consisting of vanadium, nickel, magnesium, zinc, iron, copper, iridium, manganese and titanium and mixtures thereof.

* * * * *

UNITED STATES PATENT AND TRADEMARK OFFICE

CERTIFICATE OF CORRECTION

PATENT NO.: 5,932,186

DATED: August 3, 1999

INVENTOR(S): H. Ernest Romine; James R. McConaghy, Jr.; and John A. Rodgers

It is certified that error appears in the above-identified patent and that said Letters Patent is hereby corrected as shown below:

Column 2, line 17, "firers" should be --fibers--.

Column 2, line 25, "at" should be --a--.

Column 10, line 11, "109°C." should be --100°C.--.

Column 11, line 40, "thus" should be --the--.

Signed and Sealed this

Third Day of April, 2001

*Attest:*

Nicholas P. Godici

NICHOLAS P. GODICI

*Attesting Officer*

*Acting Director of the United States Patent and Trademark Office*